US005905622A

United States Patent [19]

Finlay, Sr. et al.

[11] Patent Number: 5,905,622

[45] Date of Patent: May 18, 1999

[54] TRANSIENT VOLTAGE SURGE SUPPRESSOR WITH INTERNAL BARRIERS

[75] Inventors: David A. Finlay, Sr., Marietta; Patrick J. Murphy, Marcellus, both of N.Y.

[73] Assignee: Pass & Seymour, Inc., Solvay, N.Y.

[21] Appl. No.: 09/046,466

[22] Filed: Mar. 23, 1998

[51] Int. Cl.[6] ..... H01C 7/12

[52] U.S. Cl. ..... 361/118; 361/111; 361/746; 361/800

[58] Field of Search ..... 361/117–118, 126–127, 361/111, 56, 91, 746, 800, 758, 793–795; 174/50.59

[56] References Cited

U.S. PATENT DOCUMENTS 4,872,081 10/1989 Murphy et al. ..... 361/117
5,740,001 4/1998 Flachslaender et al. ..... 361/91

*Primary Examiner*—Jeffrey Gaffin
*Assistant Examiner*—Michael J. Sherry
*Attorney, Agent, or Firm*—Bond, Schoeneck & King, LLP; Stephen B. Salai

[57] ABSTRACT

A transient voltage surge suppressor (TVSS) receptacle having front and rear, matable casings including a plurality of through openings for receiving the blades of an electrical plug; a plurality of first components which are fixed with respect to said casings; a plurality of second components which are moveable relative to said first components; a plurality of first rigid members formed integrally with the front and rear casings and extending from inside surfaces of each casing to define recesses for receiving the components; and a separator within the periphery of the front and rear casings for insulating one or more of the plurality of first components from each other, said separator including a separator board in a plane substantially parallel with the front and rear walls and intermediate between the front and rear casings and a plurality of partitions extending outwardly from a first surface of the board into the recesses.

13 Claims, 6 Drawing Sheets

TRANSIENT VOLTAGE SURGE SUPPRESSOR WITH INTERNAL BARRIERS

FIELD OF THE INVENTION

This invention relates generally to a transient voltage surge suppressor (TVSS) receptacle for protecting components of an electrical apparatus connected to such a receptacle, and more specifically to a transient voltage surge suppressor having an insulating separator to electrically insulate different components of the receptacle from each other and to physically separate the internal components from the receptacle openings.

BACKGROUND OF THE INVENTION

In order to provide complete suppression of voltage transients in electrical circuits, and particularly circuits that include hot, neutral, and ground conductors, it is desirable to provide surge suppression utilizing such components as metal oxide varistors, bridging each of three possible pairs of conductors in which these voltage transients can occur. More specifically, it is desirable to provide a surge protection device connected between the hot and ground lines, between the hot and neutral lines and between the neutral and ground lines.

Some forms of TVSS devices, such as varistors, are subject to failure during operation, either as a result of high energy transient voltages being applied to the devices, the repetitive application of low energy transient voltages being applied to the devices, or even the long term application of steady state voltages above the suppression threshold. Such varistors are subject to failure as a result of thermal or chemical breakdown of the components of the varistor. Any of these may lead to immediate varistor failure.

As the varistor fails or begins to fail, it's surface can begin to break down, become conductive and cause short-circuiting with other conductive parts of the TVSS product. As a result, the electronic components and other metal components must be shielded from each other and/or separated by distances large enough to prevent short circuiting and premature failure of the device. Such separation distances may limit the size and number of components that can be used in a receptacle with conventional dimensions.

The failure mode associated with metal oxide varistors, produces a short circuit or low impedance failure. That is, the impedance of the device is reduced significantly below its normal operating impedance, as a result of failure. It is known to protect electrical circuits against such failure, by providing fuses in series with the varistors so that if the varistors fail, the fuses open and the varistor does not itself cause a short circuit or low impedance condition on the power circuit, which could create a risk of overloading the circuit, leading to overheating, the tripping of remote circuit breakers, or the like.

When a metal oxide varistor fails in a way that causes a series connected fuse to open, the protection provided by the varistor is lost. Moreover, the failure may be undetectable by observation of the devices connected to the circuit. Therefore, it is possible for the transient voltage protection to be lost without any obvious signs thereof, and thereafter for voltage transients to be passed unsuppressed to the equipment connected to the previously protected circuit, possibly causing damage.

U.S. Pat. No. 4,872,081 discloses an electrical receptacle having integral surge suppressors operative for protecting electrical apparatus connected to the outlets from transient line voltage surges. The receptacle has front and rear casings forming an enclosed housing for a printed circuit board and carrying contacts into which the blades of a plug connected to the receptacle are inserted. The housing includes portions cooperatively placed with respect to the circuit board to provide underlying support for the contacts, as well as to assist in positioning the circuit board relative to the housing and to maintain UL spacing of the components. The circuit components include three varistor devices for suppressing high transient voltages and the housing includes internal walls providing recesses to receive the respective varistor devices. Such a receptacle lacks a physical barrier between the electronic components and the line contacts.

It is an object of this invention to provide a transient voltage surge suppressor (TVSS) that overcomes the problems mentioned before.

It is a more particular object to provide a TVSS that includes a separator which provides a physical barrier between adjacent electronic components and between electronic components and the receptacle contacts of the device.

SUMMARY OF THE INVENTION

The transient voltage surge suppressor of the invention includes front and rear casing members configured for mating engagement to provide an enclosed housing. The disclosed and preferred embodiment is that of a duplex receptacle having two sets of openings in the front wall for receiving the blades or prongs of male plugs connected to the receptacle. The usual female receptacle contacts are positioned within the housing in registration with the blade-receiving openings, and are connected to line terminal and ground buses, each having portions accessible on the exterior of the housing for connection thereto of incoming electrical leads and grounding means.

Voltage surge protection is provided in all three modes, i.e. line-neutral, line-ground and neutral-ground, by a circuit including three varistors connected to the line terminal and ground buses, as well as a light-emitting diode and an audio alarm which, respectively, provide visual and audio indications of the operative condition of the surge suppression means. The circuit components are mounted upon a printed circuit board providing the necessary electrical connections of the components. The printed circuit board has an external configuration designed to fit within a recess in the rear casing and, in the fully assembled condition is fully encased in an epoxy potting material. An insulating separator is provided as an internal barrier to electrically insulate different components of the receptacle. The separator has an external configuration designed to fit within recesses of both the front and the rear casings when the receptacle is fully assembled.

One of the unique features of the receptacle resides in the cooperative design and positioning of portions of the front and rear casings and the insulating separator in relation to the printed circuit board, the line contact strips and the components of the visual and audio alarm indicators. A plurality of first rigid members formed integrally with the front and the rear casings extend from the inside surfaces of each casing to support components of the receptacle and form recesses for receiving components of the receptacle. The insulating separator has a board with apertures extending there through and a plurality of second rigid members formed integrally with the board and extending from the front and rear surfaces of the board into the recesses of the front and rear casings. These second rigid members include partition portions, ribs and post members. The board is positioned between the front and rear casings to provide underlying support for components of the circuit board and the contact strips and to cooperatively form barriers for insulating components of the receptacle from each other.

The separator also provides support for a moveable component of the audio alarm indicator circuit which passes through an aperture in the separator board. In particular the separator board includes a rib bridging the aperture for limiting the travel of a switch blade which protrudes through the aperture in response to a push button actuator for moving the switch blade into contact with a contact of the audio alarm circuit.

The novel aspects of this invention are set forth with particularity in the appended claims. The invention itself, together with further objects and advantages thereof may be more fully comprehended by reference to the following detailed description of a presently preferred embodiment of the invention taken in conjunction with the accompanying drawings.

DETAILED DESCRIPTION OF THE INVENTION

In order to provide a TVSS receptacle of conventional size it is desirable to keep separation distances to a minimum by providing a structural barrier between adjacent electronic components to prevent damage that may occur during the products life, and which can be used as a barrier to protect the receptacle contacts from damage that may occur to the varistor. In addition such a barrier can be cooperatively placed with respect to the receptacle housing and the circuit board to provide underlying support for the line contacts and other contacts of the device, and to maintain UL spacing of the components.

Figure 2:
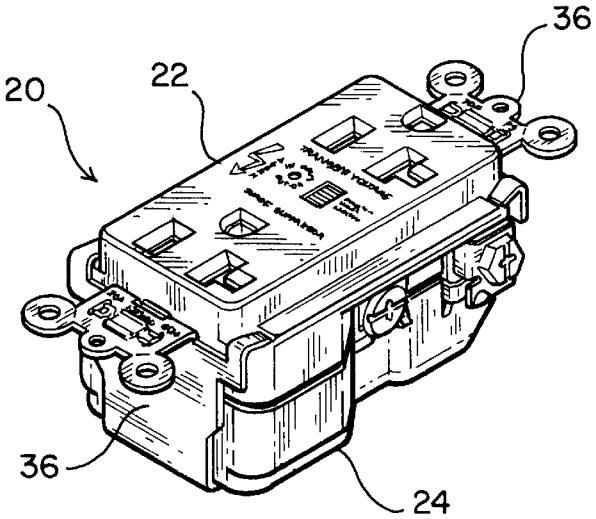
FIG. 2 is a perspective view of a fully assembled electrical receptacle seen from the upper side.
Figure 1:
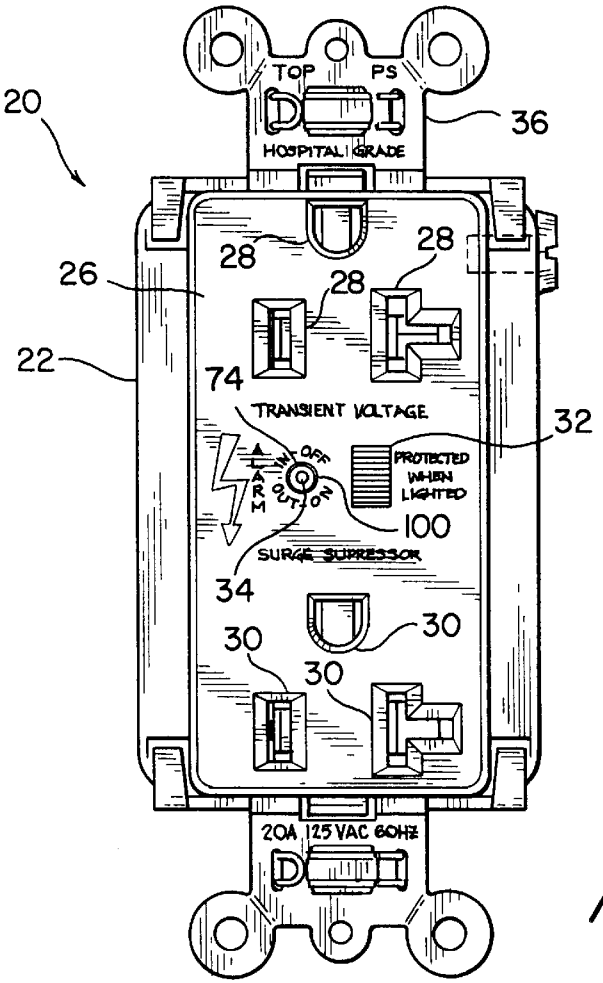
FIG. 1 is a top view of a fully assembled electrical receptacle.

Referring now to the drawings a preferred embodiment of the receptacle is shown in FIGS. 1–2. The receptacle 20 includes front and rear casings 22 and 24, respectively, having cooperatively formed edge portions for mating engagement to provide an enclosed housing for the various components, as described below. Front casing 22 includes front wall 26 having two sets of openings 28 and 30 extending there through to receive prongs of a standard form of male plug in conventional fashion. One opening of each set is shaped and positioned to receive the plug grounded prong, and the other two openings are of different sizes to insure proper polarity when a plug having no grounding prong, but prongs of different widths for connection to the hot and neutral contacts of the receptacle is inserted therein. Also mounted in openings in front wall 26, between the two sets of openings 28 and 30, are a lens 32 and a push button switch 34 for purposes described later herein.

In addition to the enclosed housing formed by front and rear casings 22 and 24, receptacle 20 includes mounting strap 36 positioned entirely exteriorly of the housing.

Figure 3:
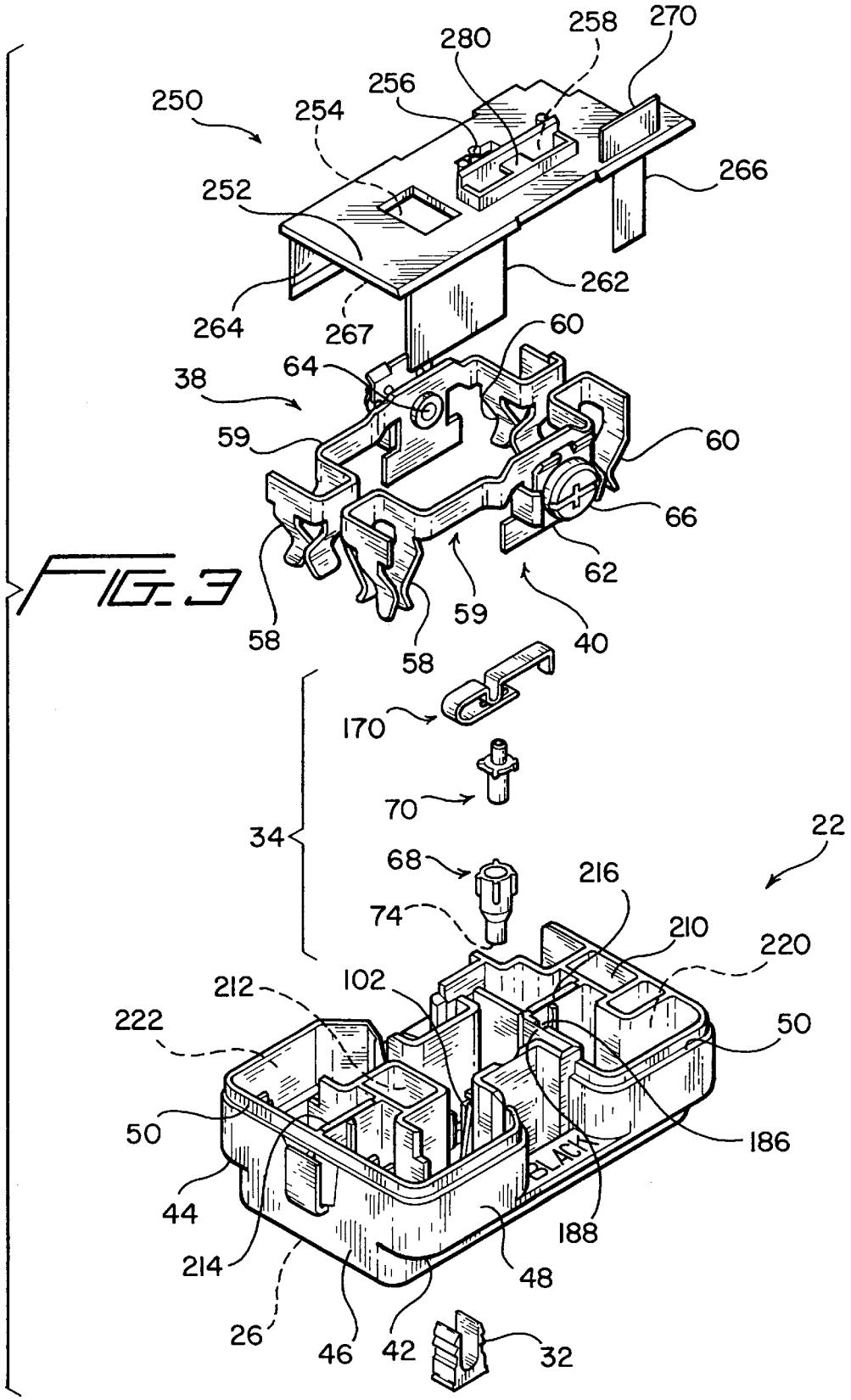
FIG. 3 is an exploded perspective view of the front casing of a receptacle showing the components and a separator board.
Figure 6:
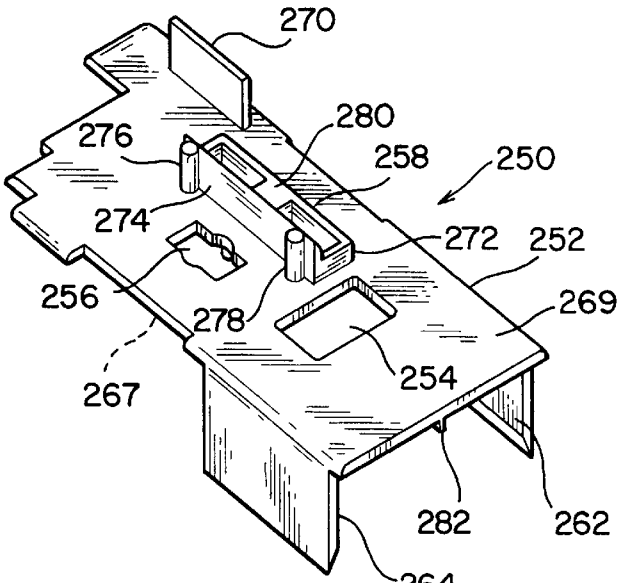
FIG. 6 is a perspective view of a separator board.
Figure 4:
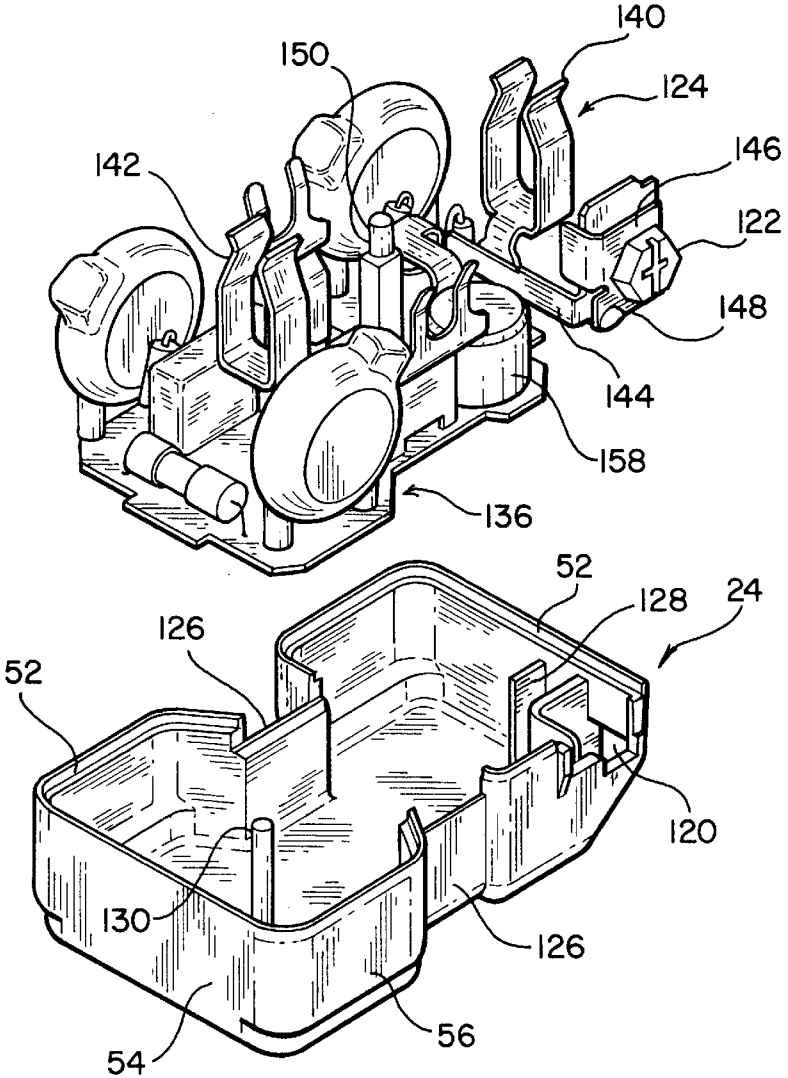
FIG. 4 is an exploded perspective view of the rear casing and the circuit board with the components mounted thereon.

Referring now to FIGS. 3 and 4, there are shown, separated from the receptacle 20, the front casing 22 and contact strips 38, 40 which fit into appropriately shaped recesses in front casing 22. Shoulders 42 and 44 extend along each side of front wall 26 of front casing 22. End wall 46 and side wall 48, as well as similar walls on the opposite end and side of front casing 22, include peripherally extending flange portions 50 for cooperative fit inside mating flanges 52 on end and side walls 54, 56, respectively of rear casing 24. It will be noted that side walls 48 of front casing 22 are not continuous, the discontinuities providing space for positioning the portions of contact strips 38, 40 to which the incoming electrical wires are attached.

Contact strips 38 and 40 are essentially identical, each being formed from a single piece of electrical conductor, stamped, punched and bent to the desired configuration. Each of contact strips 38 and 40 includes at opposite ends a pair of prong-receiving elements or contacts 58 and 60 comprising three flexible strips which are spread apart to resiliently but firmly engage the prong of an electrical plug inserted therein. The strip of metal 59 connecting contacts 58 and 60 includes a portion 62 having a threaded opening 64 for receiving screw 66 therein. When contact strips 38 and 40 are placed within the recesses provided therefor in front casing 22, portions 62 are positioned in the discontinuities in side walls 48, whereby the heads of screws 66 are accessible on the exterior of receptacle 20, as seen in FIG. 2, for attaching the line and neutral conductors of the electrical circuit in which receptacle 20 is included.

A push button switch 34 (FIGS. 1 and 3) operates to deactivate an audible alarm. An end 74 of the switch 34 is received in an aperture 100 of the front casing so that it is essentially flush with the outside surface of the front wall 26 when the alarm is activated.

Figure 7:
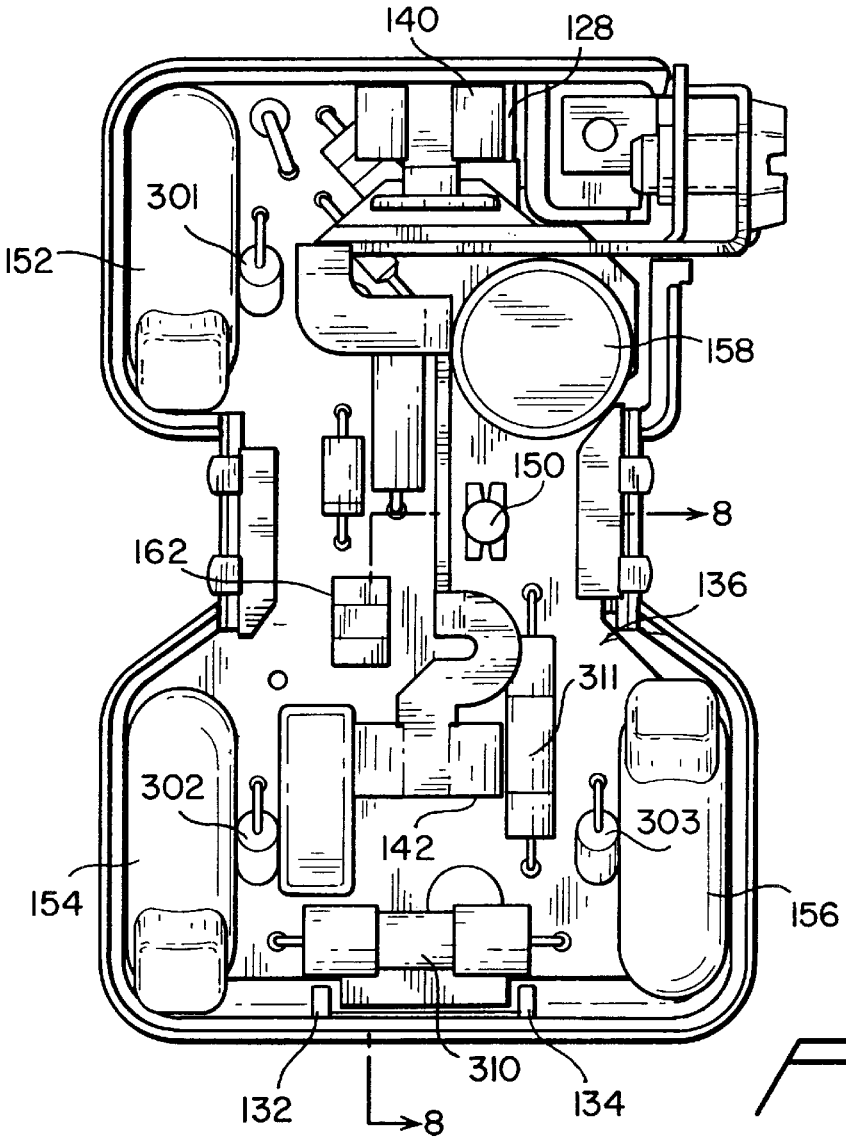
FIG. 7 is a front elevational view of the rear casing with components mounted therein.

The configuration of the rear casing 24, particularly its internal configuration, may best be seen with reference to FIGS. 4, and 7. End and side walls 54 and 56 extend continuously about the periphery of rear casing 24 and are of uniform height, except in area 120 where a portion is removed to expose screw 122 of ground bus 124. While end walls 54 are essentially planar and parallel to one another, side walls 56 are of irregular configuration in plan view, each having an inset portion 126 to conform to the configurations of side walls 48 of front casing 22. Wall portion 128 extends perpendicular from one of end walls 54 into the interior of rear casing 24, and is about three-quarters the height of the side and end walls. Post member 130 extends integrally from the inner surface into the interior of the rear casing, having a height substantially equal to that of wall 128. Rib members 132 and 134, having a height substantially equal to that of wall 128, extend perpendicularly from an end wall 54 opposite wall 128 into the interior of rear casing 24. The rear casing 24 is configured to receive a circuit board 136 which has openings and a perimeter configuration which allows the circuit board to be placed in the rear casing 24. Wall portion 128, post member 130 and rib members 132 and 134 extend above and/or through the circuit board to cooperatively support components of the circuit board.

Figure 8:
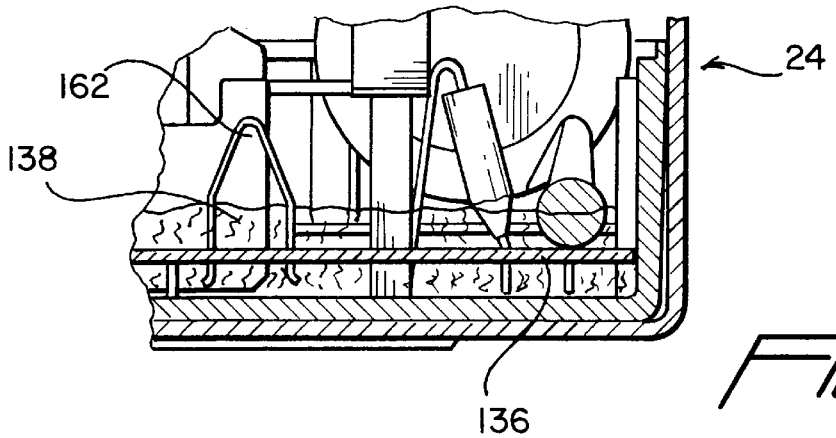
FIG. 8 is a partial side elevational view in section on the line 8—8 of FIG. 7.
Figure 9:
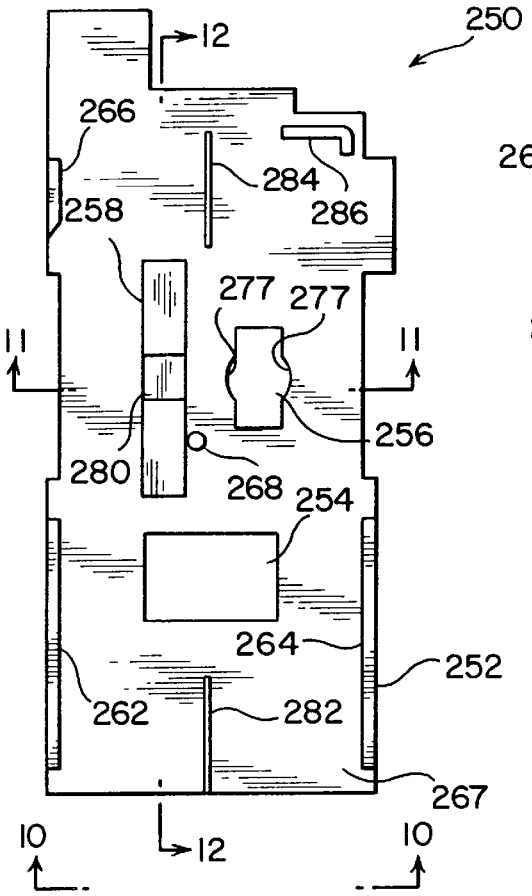
FIG. 9 is a front elevational view of the separator board.
Figure 11:
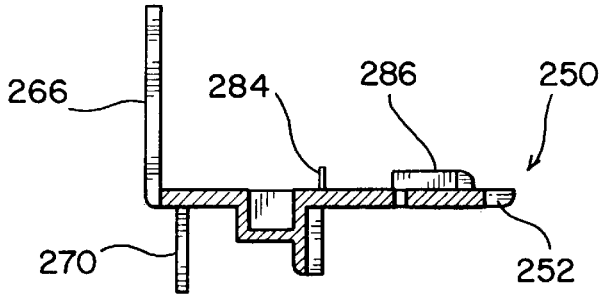
FIG. 11 is an end elevational view along the line 11—11 of FIG. 9.
Figure 10:
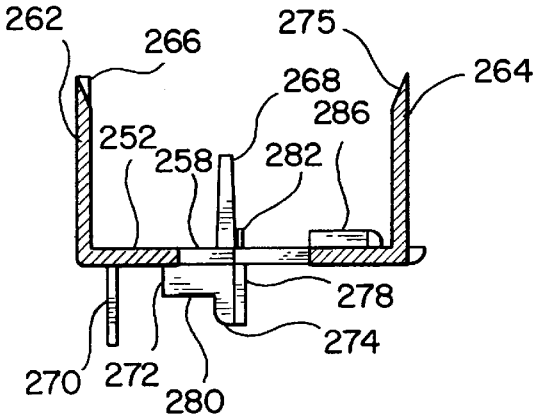
FIG. 10 is an end elevational view along the line 10—10 of FIG. 9.
Figure 12:
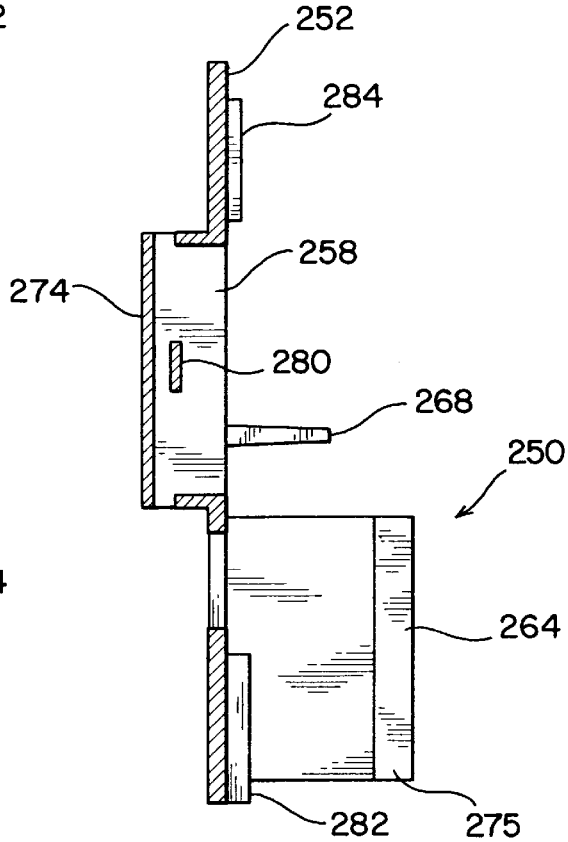
FIG. 12 is a side sectional view along the line 12—12 of FIG. 9.

Referring now to FIGS. 4, 7 and 8, components of an electrical circuit providing transient voltage suppression in receptacle 20 are mounted within rear casing 24 on a circuit board 136 embedded in potting material 138. In addition to permanently fixing the circuit board and rear casing in predetermined relation, potting material 138 provides for isolation of components, improved thermal stability through heat sinking capability, improved thermal conductivity between components and preventing conduction between components due to high voltages. Also connected to the circuit board 136 is the ground bus assembly 124 having prong receiving elements or contacts 140 and 142, each comprising a pair of flexible strips which are spread apart by insertion there between of the ground prong of an electrical plug, strip 144 to which they are riveted or otherwise attached, and screw 122, received in threaded opening 146 in upturned tab 148 of strip 144. The screw 122 provides a ground connection with a metal junction box or ground wire.

Components of the circuit board 136 have leads that extend through holes in the circuit board 136 and are soldered to printed circuit traces formed on the back of the circuit board 136, the hot, neutral and ground terminal bus assembly also have pins that protrude through the circuit board that are attached to printed circuit traces on both sides of the board. Components having leads extending through circuit board 136 for inclusion in the circuit providing transient voltage protection to an apparatus plugged into receptacle 20 include resistors, capacitors, fuses, diodes, LED 150 and metal oxide varistor (MOV) devices 152, 154, 156 and audio alarm 158. In a desired construction, the fuses protect the apparatus in the event of failure of the varistor and the capacitor provides noise suppression in the circuit.

After assembly of all components and buses on circuit board 136, including all necessary soldering connections, is complete, the board assembly is placed in rear casing 24 which is first filled to a desired level with potting material 138 in liquid form. The corners of the circuit board are trimmed to permit the potting material to flow easily over the board as the latter is pushed downwardly into the liquid since the straight edges of circuit board 136 fit rather closely within the walls of the rear casing 24.

The leads from LED 150 extend through a plastic spacer 160 which provides a desired positioning of LED 150, i.e. a standoff or spacing from board 136, directly behind lens 32. The connection of LED 150 in the circuit is such that the LED is illuminated as long as the fuses 301, 302, 303, 310, 311 are operative. If any of MOV's 152, 154 or 156, which protect the line-ground, line-neutral, and neutral-ground pairs respectively, is rendered inoperative by a high transient voltage applied thereto, an associated overcurrent fuse 310 Or 311 opens and LED 150 is extinguished. The fuse may be rated at, e.g. 5 amps. Additionally MOV's 152, 154 or 156 may begin to overheat, which may occur, for instance, at the end of their useful life or as a result of wiring errors or voltage supply anomalies. Overheating of MOV's 152, 154 or 156 will cause the opening of fuses 301, 302 and 303 respectively, and LED 150 is extinguished. These fuses may be rated at, for example 128° C. Any of fuses 301, 302, 303, 310, 311 opening provides a visual indication of the need to replace receptacle 20 in order to restore transient voltage protection. The use of LED's in this manner is conventional, as is the connection of the MOV's to provide clamping of the voltage to a safe level in all three modes, i.e. line-neutral, line-ground and neutral-ground.

Figure 5:
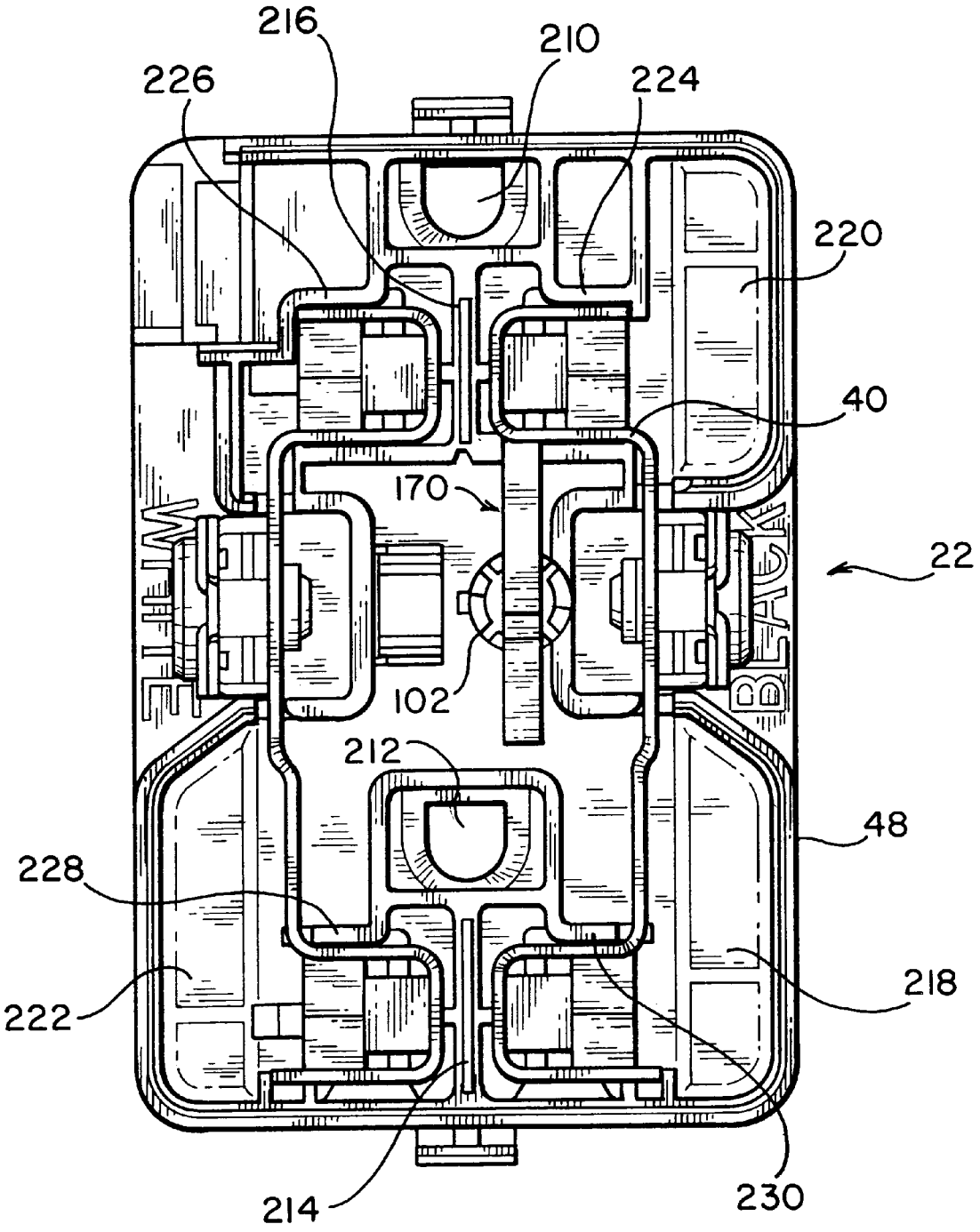
FIG. 5 is a rear elevational view of the front casing with components mounted therein.

Referring now to FIGS. 3 and 5, the inner side of front casing 22 is seen to include interior wall portions within the recess formed by end and side walls 46 and 48 respectively, to provide appropriate spaces for various elements positioned therein. Interior recesses 210 and 212 accept ground prong receiving elements 140 and 142 respectively. The line contacts 38 and 40 are positioned in the discontinuities in side walls 48 and the prong receiving elements 58 and 60 of each line contact are separated from the other by interior wall portions 214 and 216 respectively. Each of recesses 218, 220 and 222 formed by shoulders 42 and 44 and side wall 48 receive one of the varistors 154, 152 and 156 respectively therein when the receptacle 20 is assembled. Additional interior wall portions 224, 226, 228 and 230 cooperate with the exterior end walls 46 to position and support the line contacts 38 and 40.

In order to insulate the line contacts 38, 40 housed in the front casing 22 from the electronic components of the circuit board 136 housed in the rear casing 24 when the TVSS receptacle is assembled a separator 250 is constructed which, when assembled between the front and rear casings 22, 24 respectively, provides an insulating barrier between the contacts and the electronic components, and thus allows the separation distances between the contacts and the components to be kept to a minimum. In addition features of the separator provide support for other components of the receptacle as will be described below.

Referring now to FIGS. 3, 6, 9, 10, 11, 12 there is shown a separator 250 including a flat insulating board 252 with generally rectangular apertures 254, 256 and 258 extending there through. Partitions 262, 264 and 266 extend vertically from the perimeter of a surface 267 of the board 252 facing the front wall 26 of the front casing 22, each partition being essentially the same height. A post 268 extends vertically from the surface 267 and is about half the height of the partition 264. Extending vertically from the opposite surface 269 of the board 252 and spaced from the perimeter of the board is a partition 270 having a height about one third of partition 264. On the same side of the board as partition 270 the rectangular aperture 258 is surrounded on three sides by a low wall 272 and on the fourth side by a higher wall 274 rising vertically from the surface. The high wall 274 is the same height as partition 270 and the low wall 272 is about half the height of wall 274. Contacting the outer surface of wall 274 are two posts 276 and 278 of the same height as the wall 274, one post at each end of wall 274. Bridging the rectangular aperture 258 is a rib 280 connecting the upper edge of wall 272 with the middle of wall 274. The outer horizontal edges of partitions 262, 264, 270 and wall 274 and a vertical edge of partition 266 are, preferably, cut at an angle to facilitate insertion of the board over the contact strips 38 and 40 and ground bus assembly 124. Typically, the angle of cut is at 45°, as shown for edge 275 of partition 264 in FIGS. 10 and 12. Ribs 282, 284 project from surface 267 and are positioned for insertion into corresponding grooves in wall portions 214, 216, respectively, of front casing 22 to facilitate alignment of the separator 250 with the front casing 22. Similarly L-shaped rib 286 projects from surface 267 and is positioned for insertion into a corresponding recess adjacent wall portion 226 to support contact strip 38. The perimeter of the insulating board 252 is shaped to coincide with and be supported by corresponding wall portions of the front casing when the separator is assembled with the front casing.

Rectangular aperture 254 is positioned to cooperatively receive the ground prong receiving contact 126.

Rectangular aperture 256 has semi-circular recesses 277 in two opposing sides and is positioned to cooperatively receive the cylindrical-shaped LED 150 (FIG. 4).

Rib 280 of rectangular aperture 258 is positioned to cooperatively support the switch blade 170.

The separator is typically molded from a rigid, heat resistant plastic material such as nylon, for example nylon 6 or a fiber glass reinforced nylon.

The fully assembled TVSS 20 with separator 250 in place thus provides a physical barrier between each varistor and the contact strips, between the contact strips and all the electrical components of the circuit board without increasing the size of the receptacle. In addition the barrier supports stationary and moveable components of the switch While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. A transient voltage surge suppressor (TVSS) receptacle comprising;

front and rear, matable casings having respective front and rear walls, said front wall including a plurality of through openings for receiving the blades of an electrical plug, said casings when in mated relation defining an enclosed space;

a plurality of first components which are fixed with respect to said casings;

a plurality of second components which are moveable relative to said first components;

a plurality of first rigid members formed integrally with the front and rear casings and extending from inside surfaces of each casing to define recesses for receiving the components; and a separator within the periphery of the front and rear casings for insulating one or more of the plurality of first components from each other, said separator including a separator board in a plane substantially parallel with the front and rear walls and intermediate between the front and rear casings, a plurality of partitions extending outwardly from a first surface of the board into the recesses, a plurality of apertures in the board, and at least one second rigid member extending outwardly from each of the first surface and a second surface of the board to support components of the receptacle.

2. The receptacle of claim 1, in which the plurality of first components includes a substantially flat circuit board within the periphery of the rear casing carrying at least one element adapted to clamp high transient voltages imposed thereon to a lower level.

3. The receptacle of claim 2, in which the plurality of first components includes a visible indicator for indicating the failure of the at least one element.

4. The receptacle of claim 2, in which the plurality of first components includes an audio alarm assembly for indicating the failure of the at least one element.

5. The receptacle of claim 1, in which the separator further comprises a rib in one of the plurality of apertures bridging opposite sides for limiting the travel of a switch blade through the one of the plurality of apertures.

6. A separator for insulating different components of an electrical receptacle from each other, the receptacle including front and rear, matable casings defining an enclosed space when in mated relation, a plurality of rigid walls extending outwardly from an inner surface of the front casing within the periphery of the front casing to define recesses, a plurality of first components which are fixed with respect to said casings and a plurality of second components which are moveable relative to said first components, the separator comprising:

a substantially flat insulating board having first and second surfaces essentially parallel with the inner surface of the front casing;

a plurality of apertures extending through the insulating board for receiving one or more of the first and second components of the receptacle there through;

at least one rigid member extending outwardly from each of the first and second surfaces to contact and support a component of the receptacle; and a plurality of insulating partitions extending outwardly from the second surface to form with the insulating board and one or more of the plurality of rigid walls a barrier between different components of the receptacle.

7. The separator of claim 6, in which one of the plurality of apertures has a rib bridging opposite sides for limiting the travel of a switch blade adapted to be received through the one of the plurality of apertures.

8. An electrical receptacle having integral means for suppressing high transient voltages in the power provided by the receptacle to electrical equipment connected thereto, the receptacle comprising:

a rear casing having a back wall;

a first side wall extending integrally from the back wall about the entire periphery thereof and perpendicular thereto;

a substantially flat printed circuit board carrying a plurality of components including at least one element adapted to clamp high transient voltages imposed thereon to a lower level, the circuit board having a peripheral configuration fitting within the side wall and in a plane substantially parallel with an inner surface of the back wall;

a front casing having a front wall;

a plurality of openings in the front wall for receiving the male blades of a plug connected to the receptacle;

a second sidewall extending integrally from the front wall about the entire periphery thereof and perpendicular thereto for cooperatively aligning with the circuit board and the rear casing to form therewith an enclosed housing containing the circuit board;

a plurality of first rigid members extending outwardly from an inner surface of the front wall within the periphery of the front wall;

a plurality of recesses formed by one or more of the first rigid members with one or more of another of the first rigid members, the front wall and the second sidewall;

first and second contact strips, each contact strip having at least one female contact for receiving the male blade of a plug connected to the receptacle, each contact strip supported by one or more of the first rigid members and each female contact adapted to fit in one of the plurality of recesses; and an insulating separator between the front casing and the rear casing, the separator comprising a substantially flat insulating board having first and second surfaces in a plane substantially parallel with an inner surface of the front wall, a plurality of apertures extending through the insulating board for receiving components of the circuit board there through, at least one second rigid member extending outwardly from the first surface within the periphery of the rear casing to contact and support the circuit board, and a plurality of partitions extending outwardly from the second surface into the recesses of the front casing to contact the inner surface of the front wall and form a barrier between the at least one element and each of the first and second strips.

9. The receptacle of claim 8, in which the circuit board carries at least one female contact for receiving a male blade of a plug connected to the receptacle.

10. The receptacle of claim 9, further comprising first and second line terminals connected to the first and second contact strips respectively.

11. The receptacle of claim 10, further comprising first and second line contacts carried by the circuit board for connecting with the first and second line terminals respectively.

12. The receptacle of claim 8, in which the circuit board carries a ground bus.

13. The receptacle of claim 8, in which the separator further comprises a rib in one of the plurality of apertures bridging opposite sides for limiting the travel of a switch blade through the one of the plurality of apertures.

* * * * *